US010624409B2

(12) United States Patent
Chan

(10) Patent No.: US 10,624,409 B2
(45) Date of Patent: Apr. 21, 2020

(54) METHOD FOR MANUFACTURING AN INTEGRALLY FORMED CAP AND A CAP MANUFACTURED BY THE METHOD

(71) Applicant: Yi Shiang Chan, Zhongshan (CN)

(72) Inventor: Yi Shiang Chan, Zhongshan (CN)

( * ) Notice: Subject to any disclaimer, the term of this patent is extended or adjusted under 35 U.S.C. 154(b) by 211 days.

(21) Appl. No.: 15/631,706

(22) Filed: Jun. 23, 2017

(65) Prior Publication Data

US 2018/0184748 A1 Jul. 5, 2018

(30) Foreign Application Priority Data

Dec. 29, 2016 (CN) ..... 2016 1 1245345

(51) Int. Cl.

| | |
|---|---|
| ***A42C 2/00*** | (2006.01) |
| ***A42B 1/00*** | (2006.01) |
| ***A42C 1/00*** | (2006.01) |
| *D04H 5/06* | (2006.01) |

(52) U.S. Cl.

CPC ..... *A42C 2/002* (2013.01); *A42B 1/002* (2013.01); *A42C 1/00* (2013.01); *D04H 5/06* (2013.01)

(58) Field of Classification Search

CPC ..... A42B 1/04; A42B 1/002; A42B 1/069; A42B 1/208; A42B 1/004; A42B 1/248; A42C 2/002; A42C 1/04; A42C 1/00; A42C 1/02; A42C 1/08; D04H 5/06

USPC ..... 2/209.12; 264/241

See application file for complete search history.

(56) References Cited

U.S. PATENT DOCUMENTS 1,682,870 A * 9/1928 Heusen ..... A42C 1/04 2/200.1
2,495,640 A * 1/1950 Muskat ..... B29C 70/467 264/257
3,156,926 A * 11/1964 Hoffman ..... A42C 1/02 156/85
3,597,800 A * 8/1971 Silverman ..... A41C 5/005 425/290
3,673,611 A * 7/1972 Cain ..... A41C 5/005 2/175.1
4,385,655 A * 5/1983 Tisdale, Jr. ..... B22D 19/00 164/112
5,066,442 A * 11/1991 Gutowski ..... B29C 33/0033 264/154
5,343,567 A * 9/1994 Zumbiel ..... A42B 1/004 2/195.1
5,943,702 A * 8/1999 Kronenberger ..... A42C 5/00 2/171.1

(Continued)

*Primary Examiner* — Alissa L Hoey

(74) *Attorney, Agent, or Firm* — Myers Wolin, LLC

(57) ABSTRACT

A method is providing for manufacturing an integrally formed cap, the method comprising: in step 1, providing a shell fabric B and a thermoplastic lining fabric C, superposing the shell fabric on a surface of the lining fabric and tightly attaching the shell fabric to the lining fabric, to obtain the fabric A needed, and providing the shaping mold matched with the shape of a cap; in step 2, cutting the fabric A obtained in Step 1 into set dimensions; and in step 3, tightly attaching the fabric A cut in Step 2 onto the shaping mold obtained in Step 1, thermally shaping the fabric A by a container, so as to integrally shape the fabric A into the cap. With the method of the invention, the production speed and quality stability can be increased, the production cost reduced, and the production process is energy-saving and environment-friendly.

6 Claims, 2 Drawing Sheets

(56) References Cited

U.S. PATENT DOCUMENTS 6,089,421 A * 7/2000 Cho ..... A42C 1/06 223/12
6,158,053 A * 12/2000 Wang ..... A42B 1/004 2/175.1
6,272,689 B1 * 8/2001 Kronenberger ..... A42B 1/062 2/175.1
6,370,696 B1 * 4/2002 Kronenberger ..... A42B 1/062 2/175.1
7,048,985 B2 * 5/2006 Mack ..... B29C 70/24 428/105
2006/0005298 A1 * 1/2006 Kim ..... A42B 1/248 2/209.13
2006/0112475 A1 * 6/2006 Wang ..... A42B 1/02 2/195.5
2008/0086793 A1 * 4/2008 Higgins ..... A42B 1/248 2/209.13
2008/0201824 A1 * 8/2008 Kronenberger ..... A42B 1/248 2/195.1
2009/0025121 A1 * 1/2009 Remo ..... A42B 1/248 2/171
2009/0106877 A1 * 4/2009 Kim ..... A42B 1/004 2/195.1
2012/0272432 A1 * 11/2012 Cho ..... A42B 1/002 2/181
2013/0205473 A1 * 8/2013 Kronenberger ..... A42B 1/248 2/209.13
2015/0082835 A1 * 3/2015 Xu ..... A42B 1/18 66/171
2016/0000160 A1 * 1/2016 Kronenberger ..... A42B 1/248 428/131
2016/0193765 A1 * 7/2016 Chan ..... B29C 45/16 2/195.1
2016/0327708 A1 * 11/2016 Liles ..... G02B 5/22
2017/0265552 A1 * 9/2017 Lau ..... A42B 1/062
2018/0110282 A1 * 4/2018 Zhang ..... A42B 1/004

* cited by examiner

METHOD FOR MANUFACTURING AN INTEGRALLY FORMED CAP AND A CAP MANUFACTURED BY THE METHOD

CROSS-REFERENCE TO RELATED APPLICATIONS

This application claims priority to Chinese Application No. 201611245345.9, filed Dec. 29, 2016, the contents of which are hereby incorporated by reference.

FIELD OF THE INVENTION

The present invention relates to caps, and in particular to a method for manufacturing an integrally formed cap and a cap manufactured by the method.

BACKGROUND

It is known that, most of conventional caps are produced by adopting a method in which a fabric is cut into multiple splicing pieces and then the splicing pieces are sewed together into a cap with a needle and threads. Such a method for producing caps has a lot of steps is complex in process and low in production efficiency. Moreover, in the process of cutting the fabric, a lot of rags will be produced, thus leading to waste of production material and high production cost. Furthermore, the quality of caps produced by the above-mentioned method is unstable and often fluctuates.

Integrally formed caps have also appeared in the market. Generally, these caps can only be produced by adopting knitted fabrics or leathers rather than woven fabrics. Knitted caps which are produced by knitted fabrics are not suitable for printing and laser cutting due to the sparse knitted structure of the knitted fabrics and the material characteristics of knitting yarns, while leather caps which are produced by leathers are generally not suitable for dyeing and finishing or laser cutting because of costs or rough edges. As a result, the production costs of conventional shaped caps are high, and appearances are monotonous and dull, thus failing to satisfy individualized demands of different users.

In addition, the main reason why the conventional integrally formed caps seldom use woven fabrics is that creases, raveled yarns or broken yarns are likely to occur after a flat fabric is pressed into a three-dimensional cloth cap. As a result, if patterns are processed on the fabric by printing, embroidery or laser cutting, they may be subjected to deformation, breakage, etc.

SUMMARY

For solving the above-mentioned problems, the objective of the present invention is set to provide a manufacturing method characterized in simplified steps and reduced production costs. Moreover, according to the invention, caps can be produced with various patterns, and can be better matched in shape with the head of a user.

The technical solution adopted by the invention to solve the technical problems is described as follows.

A method for manufacturing an integrally formed cap comprises the following steps:

Step 1, preparing a fabric A and providing a shaping mold: providing a shell fabric B and a thermoplastic lining fabric C, superposing the shell fabric B on a surface of the lining fabric C and tightly attaching the shell fabric B to the lining fabric C, to obtain the fabric A needed, and providing the shaping mold which matches the shape of a cap;

Step 2, cutting: cutting the fabric A obtained in Step 1 into set dimensions;

Step 3, thermally shaping: tightly attaching the fabric A cut in Step 2 onto the shaping mold obtained in Step 1, thermally shaping the fabric A by a container, so as to integrally shape the fabric A into the cap, thereby obtaining a product needed.

As an improvement to the above-mentioned technical solution, the shell fabric B in Step 1 comprises one or two or more layers of fabric, and the lining fabric C is a woven piece woven from stabilized yarns or from stabilized yarns and yarns.

As an improvement to the above-mentioned technical solution, the lining fabric C is chemical fiber lining, cotton lining, or wool lining or combinations thereof.

As an improvement to the above-mentioned technical solution, in step 1 before the shell fabric B and the lining fabric C are appressed together to form the fabric A, the shell fabric B is subjected to one or more of printing, embroidery, laser cutting and dyeing and finishing.

Further, in step 1 the shell fabric B and the lining fabric C are bonded or sewed together.

Further, in step 1 the shell fabric B and the lining fabric C are bonded together by adhesive, and the adhesive is one or more of environment-friendly resin, TPU and hot melt adhesive.

Yet further, the method comprises a step of shaping the cap after the fabric A is thermally shaped into the cap in Step 3.

A cap comprises a cap body, which comprises a decorative layer located in the outer and a supporting layer located inside the decorative layer The present invention has the following advantages: the shell fabric B and the thermoplastic lining fabric C are appressed together to form the fabric A, the fabric A is then appressed on the outer surface of the shaping mold, and finally the fabric A is thermally shaped into an integrally formed cap; therefore not only is the cap production speed greatly increased and the stability of cap quality effectively guaranteed, but also the fabric does not need to be cut into multiple splicing pieces, thereby greatly reducing the rags and saving the fabrics, thus the production process of the present invention not only results in a reduced production cost, but also is energy-saving and environment-friendly.

Moreover, according to the invention, before being produced into the fabric A, the shell fabric B is a piece of flat fabric. Thus, printing, embroidery, laser cutting or dyeing and finishing can be performed on the shell fabric B for producing various patterns or textures or three-dimensional patterns on the surface of the shell fabric B, for diverse appearances, satisfying individualized demands of different users.

In addition, according to the present invention the fabric A is attached tightly to and cover the outer surface of the shaping mold and then shaped integrally into the cap by thermoplastic shaping, thus the conventional method, in which pressing or squeezing a fabric when producing a cap by integral forming is required, is abandoned, and whereby creases, raveled yarns or broken yarns caused by pressing or squeezing are prevented from occurring on fabrics.

In cap production with the method of the invention, as long as the mold matched the head of a user in shape is provided, the cap matched with the head of the user in shape can be formed thermally, so that the cap produced with the method of the present invention can be better adapted to the head of the user in shape.

BRIEF DESCRIPTION OF THE DRAWINGS

The present invention is further described in detail below in reference to the drawings and specific embodiments.

DETAILED DESCRIPTION OF THE PREFERRED EMBODIMENTS

Figure 1:
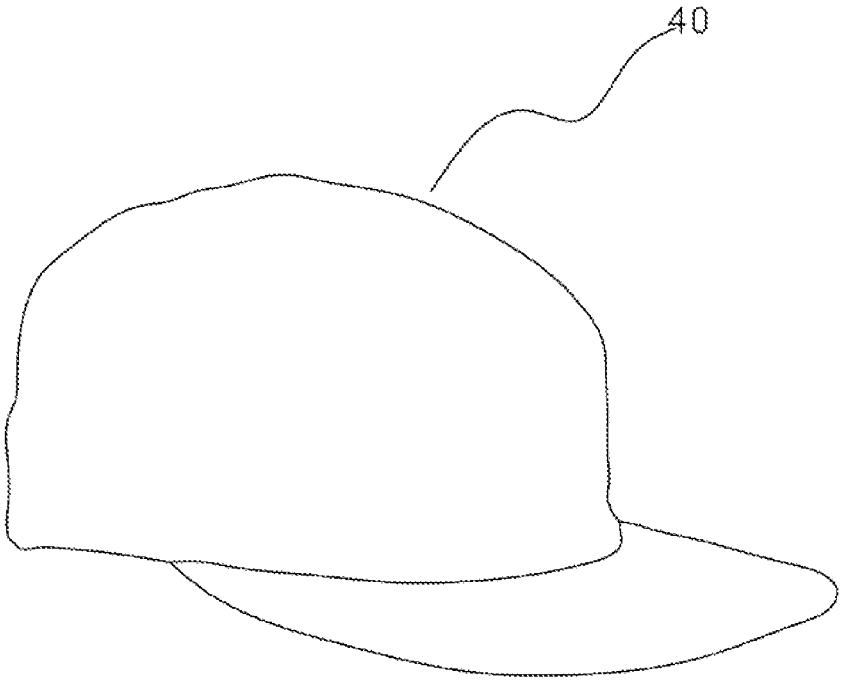
FIG. 1 is a schematic view of a cap produced by the method according to the present invention.
Figure 2:
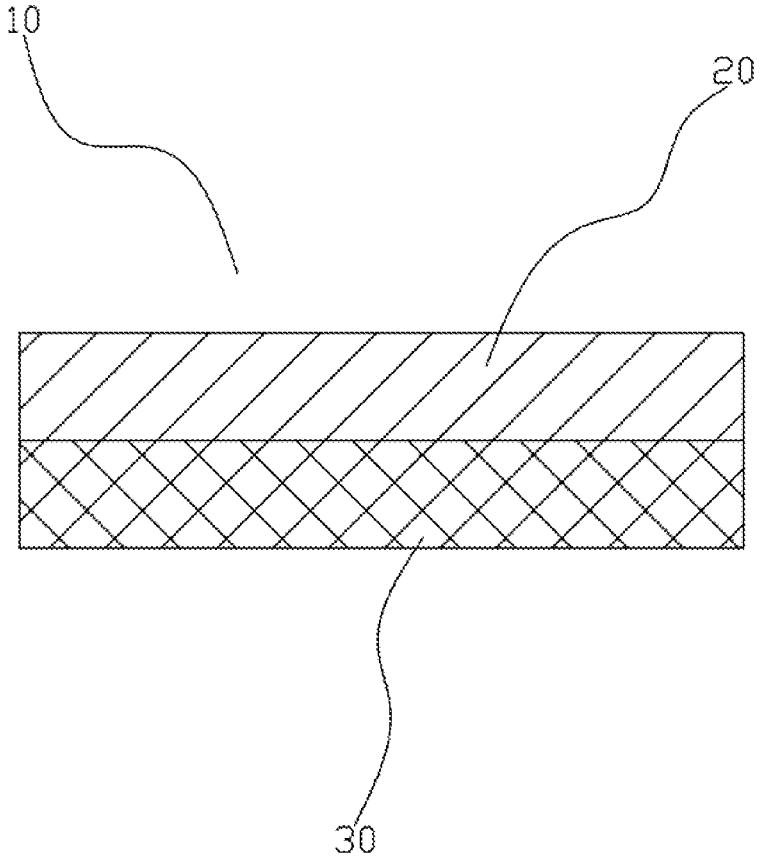
FIG. 2 is a schematic view of a fabric A used to manufacturing the cap according to the present invention.

As shown in FIG. 1 and FIG. 2, a method for manufacturing an integrally formed cap is disclosed. The method comprises the following steps.

Step 1—preparing a fabric A 10 and a shaping mold: providing a shell fabric B 20 and a thermoplastic lining fabric C 30, superposing the shell fabric B 20 on a surface of the lining fabric C 30 and tightly attaching the shell fabric B 20 and the lining fabric C 30 to each other, to obtain the fabric A 10 needed; wherein, according to needs, the area of the lining fabric C 30 may be equal to or smaller than it of the shell fabric B 20, i.e. the shell fabric B 20 may be partially or completely covered by the lining fabric C 30, even no lining fabric C 30 is comprised; providing the shaping mold which matches a cap in shape; wherein the shell fabric B 20 comprises one or two or more layers of fabric, and the lining fabric C 30 is a woven piece woven from stabilized yarns or from stabilized yarns and yarns; the lining fabric C 30 may be another material or combinations of various materials, including chemical fiber lining, cotton lining, and wool lining.

Step 2—cutting: cutting the fabric A 10 obtained in Step 1 into set dimensions.

Step 3—thermally shaping: tightly attaching the fabric A 10 cut in Step 2 onto the shaping mold provided in Step 1, thermally shaping the fabric A 10 by a container, so as to integrally shape the fabric A into the cap expected; wherein the fabric A 10 first is covered on the shaping mold, a rope or an elastic is then used to tie the lower edge of the fabric A 10 to allow the fabric A 10 to be appressed completely on the surface of the shaping mold, after that both the shaping mold and the fabric A 10 are placed into a sealed container for thermoplastic shaping; alternatively, the shaping mold is placed into a container first, the fabric A 10 is then covered on the shaping mold, next the container is sealed, and finally the fabric A 10 is shaped thermoplastically by the container; as a preferred embodiment of the present invention, the container can be hermetically closed, that is, the container can be opened or closed.

According to the invention, the shell fabric B 20 and the thermoplastic lining fabric C 30 are appressed together to form the fabric A 10, which is then appressed on the outer surface of the shaping mold for thermoplastically shaping, whereby a cap with a shape matched with the shaping mold is formed from the fabric A 10, and thus the objective of producing an integrally formed cap is achieved. Therefore, for cap production, production speed is greatly increased and quality stability is effectively guaranteed. Furthermore, as the fabric no longer needs to be cut into multiple splicing pieces, thereby resulting in greatly reduced rags, fabrics are saved. Resulting from above, the production process according to the present invention is characterized in reduced production costs, energy-saving and environment-friendly.

Moreover, before being produced into the fabric A 10, the shell fabric B 20 in the present invention is a piece of flat fabric, thus printing, embroidery, laser cutting or dyeing and finishing can be easily carried out on the shell fabric B 20 to produce various patterns or textures or three-dimensional patterns on the surface of the shell fabric B 20, for divers appearances, to satisfy individualized demands from different users.

In addition, the fabric A 10 according to the present invention is attached tightly to and covers the outer surface of the shaping mold, and then shaped integrally into the cap by thermoplastic shaping, thus the conventional method in which fabric pressing or squeezing is required in cap production by integral forming is abandoned, and whereby creases, raveled yarns or broken yarns caused by pressing or squeezing are prevented from occurring on fabrics.

For more attractive, elegant and diversified appearance, with the production process of the present invention, preferably, before the shell fabric B 20 and the lining fabric C 30 in Step 1 are appressed together to form the fabric A 10, the shell fabric B 20 has been subjected to one or more of printing, embroidery, laser cutting and dyeing and finishing. That is, before the shell fabric B 20 and the lining fabric C 30 are combined, one or more of printing, embroidery, laser cutting and dyeing and finishing are carried out on the shell fabric B 20.

By performing printing, embroidery, laser cutting or dyeing and finishing processes on the shell fabric B 20, the shell fabric B 20 can be more three-dimensional and diversified in shape or pattern, so that the produced cap can be more diversified and three-dimensional in appearance as well, and thereby satisfying the demands of different users on different appearances of caps.

According to the present invention, for tighter and firmer bonding between the shell fabric B 20 and the lining fabric C 30, preferably, in Step 1 the shell fabric B 20 and the lining fabric C 30 can be stuck or sewed together. As a preferred embodiment of the present invention, in Step 1 the shell fabric B 20 and the lining fabric C 30 are stuck together by adhesive, and the adhesive is one or more of environment-friendly resin, TPU and hot melt adhesive.

For more attractive and elegant appearance, preferably, formed from the fabric A 10 by thermoplastically shaping in Step 3, the cap is then processed by shape correction. By carrying out shape correction on the cap, deformed parts of the cap which are caused during the production process can be corrected, such that the cap produced can be in consistence with the designed shape, for better appearance.

The present invention will be described in detail with different embodiments in which different materials are used to produce the cap.

Embodiment 1

The method for manufacturing an integrally formed cap comprises the following steps.

Step 1—preparing a fabric A 10 and a shaping mold: a cotton fabric is selected as the shell fabric B 20, a woven piece woven from stabilized yarns is selected as the lining fabric C 30, the adhesive is applied on the shell fabric B 20 and/or the lining fabric C 30, the shell fabric B 20 is attached gently to the lining fabric C 30 and the two are then pressed gently towards each other, whereby the shell fabric B 20 and the lining fabric C 30 are bonded by the adhesive applied on the shell fabric B 20 and/or the lining fabric C 30 to form the fabric A 10; preferably, while the shell fabric B 20 and the lining fabric C 30 are squeezed to against each other, the temperature is 10° C. to 110° C., the squeezing pressure is 0.3 MPa to 0.6 MPa, and the duration is 5 to 90 seconds; in addition, the shaping mold matched with the shape of a cap is provided, and the shape of the shaping mold can be various, depending on the shape of the cap to be produced;

Step 2—cutting: the fabric A 10 obtained in Step 1 is cut into set dimensions;

Step 3—thermoplastic shaping: The fabric A 10 cut in Step 2 is attached tightly to and covers the shaping mold provided in Step 1, the fabric A 10 is then shaped thermoplastically by a container, to integrally shaping the fabric A 10 into the cap, thereby obtaining the needed product; in the embodiment, the thermoplastic shaping is performed on the fabric A 10 with the shaping mold in the container, the temperature in the container is 100° C. to 160° C., the pressure is 0.4 MPa to 0.5 MPa, and the time is 10 to 60 seconds; after that, the temperature in the container is kept between 5° C. and 30° C., cooling the fabric A 10 for 10 to 30 seconds.

The container is then opened, the temperature in the container is kept between 90° C. to 130° C., and shape correction is carried out on the fabric A 10 in the atmospheric environment for correcting deformed parts of the fabric A 10, lasting for 10 to 60 seconds.

Finally, the temperature of the container is kept between 5° C. to 30° C. for 10 to 60 seconds for cooling, the fabric A 10 is then taken off from the shaping mold, and the desired cap is obtained by integral forming.

Embodiment 2

The method for manufacturing an integrally formed cap comprises the following steps.

Step 1—preparing a fabric A 10 and a shaping mold: a woolen is selected as the shell fabric B 20, a woven piece woven from stabilized yarns is selected as the lining fabric C, the adhesive is applied on the shell fabric B 20 and/or the lining fabric C 30, the shell fabric B 20 is attached gently to the lining fabric C 30 and the two are then pressed gently towards each other, whereby the shell fabric B 20 and the lining fabric C 30 are bonded by the adhesive applied on the shell fabric B 20 and/or the lining fabric C 30 to form the fabric A 10; preferably, while the shell fabric B 20 and the lining fabric C 30 are squeezed to against each other, the temperature is 10° C. to 100° C., the squeezing pressure is 0.3 MPa to 0.5 MPa, and the duration is 5 to 100 seconds; in addition, the shaping mold matched with the shape of a cap is provided, and the shape of the shaping mold can be various, depending on the shape of the cap to be produced;

Step 2—cutting: the fabric A 10 obtained in Step 1 is cut into set dimensions;

Step 3—thermoplastic shaping: The fabric A 10 cut in Step 2 is attached tightly to and covers the shaping mold provided in Step 1, the fabric A 10 is then shaped thermoplastically by a container, to integrally shaping the fabric A 10 into the cap, thereby obtaining the needed product; in the embodiment, the thermoplastic shaping is performed on the fabric A 10 with the shaping mold in the container, the temperature in the container is 100° C. to 140° C., the pressure is 0.3 MPa to 0.6 MPa, and the time is 10 to 60 seconds; after that, the temperature in the container is kept between 0° C. and 30° C., cooling the fabric A 10 for 10 to 40 seconds.

The container is then opened, the temperature in the container is kept between 90° C. to 130° C., and shape correction is carried out on the fabric A 10 in the atmospheric environment for correcting deformed parts of the fabric A 10, lasting for 10 to 60 seconds.

Finally, the temperature of the container is kept between 5° C. to 30° C. for 10 to 60 seconds for cooling, the fabric A 10 is then taken off from the shaping mold, and the desired cap is obtained by integral forming.

Embodiment 3

The method for manufacturing an integrally formed cap comprises the following steps.

Step 1—preparing a fabric A 10 and a shaping mold: fibers are selected as the shell fabric B 20, a woven piece woven from stabilized yarns is selected as the lining fabric C, the adhesive is applied on the shell fabric B 20 and/or the lining fabric C 30, the shell fabric B 20 is attached gently to the lining fabric C 30 and the two are then pressed gently towards each other, whereby the shell fabric B 20 and the lining fabric C 30 are bonded by the adhesive applied on the shell fabric B 20 and/or the lining fabric C 30 to form the fabric A 10; preferably, while the shell fabric B 20 and the lining fabric C 30 are squeezed to against each other, the temperature is 40° C. to 180° C., the squeezing pressure is 0.3 MPa to 0.7 MPa, and the duration is 10 to 80 seconds; in addition, the shaping mold matched with the shape of a cap is provided, and the shape of the shaping mold can be various, depending on the shape of the cap to be produced;

Step 2—cutting: the fabric A 10 obtained in Step 1 is cut into set dimensions;

Step 3—thermoplastic shaping: The fabric A 10 cut in Step 2 is attached tightly to and covers the shaping mold provided in Step 1, the fabric A 10 is then shaped thermoplastically by a container, to integrally shaping the fabric A 10 into the cap, thereby obtaining the needed product; in the embodiment, the thermoplastic shaping is performed on the fabric A 10 with the shaping mold in the container, the temperature in the container is 100° C. to 150° C., the pressure is 0.3 MPa to 0.6 MPa, and the time is 10 to 60 seconds; after that, the temperature in the container is kept between 5° C. and 25° C., cooling the fabric A 10 for 10 to 30 seconds.

The container is then opened, the temperature in the container is kept between 90° C. to 120° C., and shape correction is carried out on the fabric A 10 in the atmospheric environment for correcting deformed parts of the fabric A 10, lasting for 10 to 60 seconds.

Finally, the temperature of the container is kept between 5° C. to 30° C. for 10 to 60 seconds for cooling, the fabric A 10 is then taken off from the shaping mold, and the desired cap is obtained by integral forming.

Referring to FIG. 1 and FIG. 2, disclosed is a cap produced by the above-mentioned production process. The cap of the invention comprises a cap body 40 comprising a decorative layer located on the outer and a supporting layer located inside the decorative layer. Specifically, the decorative layer is formed by the shell fabric B 20, and the supporting layer is formed by the lining fabric C 30 and plays a supporting role.

In the cap production according to the method of the present invention, once the mold matched with the shape of the head of a user is provided, the cap matched the shape of the head of the user can be formed thermoplastically on it and thus the cap produced by the production method of the present invention can be better adapted in shape to the head of the user. The shape of the head of the user can be measured by scanning, the mold with the same shape as the head of the user is then produced by 3D printing, and the cap which better matches the shape of the head of the user can be produced by adopting the mold. In addition, caps can be produced with different materials, and with certain elasticity rather than being completely solidified or hardened in form, for convenient wearing.

Described above are merely preferred embodiments of the present invention, and any technical solutions which achieve the objective of the present invention with basically the same means shall fall within the protection scope of the invention.

What is claimed is:

1. A method for manufacturing an integrally formed cap, the method comprising:

at a first step:

providing a piece of flat shell fabric B and a thermoplastic lining fabric C, wherein an area of the lining fabric C is smaller than that of the shell fabric B;

performing at least one of printing, embroider, laser cutting, and dyeing and finishing on the shell fabric B to form patterns or textures on a surface of the shell fabric B;

at a second step:

combining the shell fabric B and the lining fabric C to form a fabric A, and providing a shaping mold for forming a shape of the cap;

at a third step:

cutting the fabric A; and at a fourth step:

placing the cut fabric A onto an outer surface of the shaping mold; and thermally shaping the fabric A placed on the outer surface of the shaping mold, so as to shape the fabric A into the integrally formed cap.

2. The method of claim 1, wherein the shell fabric B of the first step comprises one or two or more layers of fabric.

3. The method of claim 1, wherein the lining fabric C comprises chemical fiber, cotton, or wool or combinations thereof.

4. The method of claim 1, wherein in the second step, combining the shell fabric B and the lining fabric C to form a fabric A includes bonding or sewing the shell fabric B and the lining fabric C together to form fabric A.

5. The method of claim 4, wherein in the second step the shell fabric B and the lining fabric C are bonded together by adhesive, and the adhesive is one or more of resin, TPU and hot melt adhesive.

6. A cap manufactured using the method of claim 1, the cap comprising a cap body which comprises a decorative layer on an outer surface and a supporting layer on an inner surface, the decorative layer being formed by the shell fabric B, and the supporting layer being formed by the lining fabric C.

* * * * *